US007585177B2

(12) United States Patent
Yashiki et al.

(10) Patent No.: US 7,585,177 B2
(45) Date of Patent: Sep. 8, 2009

(54) DISCHARGE LAMP SOCKET

(75) Inventors: Satoru Yashiki, Shizuoka (JP); Hiromi Umehara, Shizuoka (JP); Tetsuya Takahashi, Tokyo (JP)

(73) Assignees: Koito Manufacturing Co., Ltd., Tokyo (JP); Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/190,006

(22) Filed: Aug. 12, 2008

(65) Prior Publication Data

US 2009/0047831 A1 Feb. 19, 2009

(30) Foreign Application Priority Data

Aug. 13, 2007 (JP) ..... 2007-210938

(51) Int. Cl.
*H01R 33/945* (2006.01)

(52) U.S. Cl. ..... 439/226

(58) Field of Classification Search ..... 439/226, 439/236, 699.2, 620.02, 336; 313/318.12; 315/56, 276

See application file for complete search history.

(56) References Cited

U.S. PATENT DOCUMENTS 5,814,927 A * 9/1998 Chen ..... 313/318.03
6,049,163 A * 4/2000 Masuda et al. ..... 313/318.12
6,364,515 B1 * 4/2002 Daub et al. ..... 362/548
6,404,142 B2 * 6/2002 Miyata et al. ..... 315/274
6,429,591 B1 * 8/2002 Takamatsu et al. ..... 315/56
6,641,418 B2 * 11/2003 Takahashi et al. ..... 439/226
7,052,301 B2 * 5/2006 Garcia et al. ..... 439/336
7,204,711 B2 * 4/2007 Garcia et al. ..... 439/336
2005/0062393 A1 * 3/2005 Behr et al. ..... 313/318.01

FOREIGN PATENT DOCUMENTS

JP 2005-285368 10/2005

* cited by examiner

*Primary Examiner*—Alexander Gilman
(74) *Attorney, Agent, or Firm*—Fish & Richardson P.C.

(57) ABSTRACT

A socket includes a housing having a first housing portion and a second housing portion attachable to the first housing portion to cover the first housing portion, a starter transformer and accommodated inside the housing, a central terminal coupled to the starter transformer and disposed inside the housing such that, when the discharge lamp is attached to the socket, a central electrode of the discharge lamp contacts the central terminal. The first housing portion has a base, and a first wall portion extending from the base in a direction in which the discharge lamp is attached to the socket. The second housing portion has a second wall portion which, when the first and second housing portions are attached together, overlaps with the first wall portion such that the first and second wall portions surround the central terminal on an inner side of a peripheral edge of the base.

11 Claims, 6 Drawing Sheets

DISCHARGE LAMP SOCKET

RELATED APPLICATION

This application claims the benefit of priority of Japanese Patent Application No. 2007-210938, filed on Aug. 13, 2007. The disclosure of that application is incorporated herein by reference.

FIELD OF THE INVENTION

The present disclosure relates to a socket to which a discharge lamp for a vehicle headlight is attachable.

BACKGROUND

A known discharge lamp socket includes a starter transformer, a board on which capacitors and a spark gap are mounted, and a cover in which the starter transformer and the board are accommodated (see, e.g., Japanese Patent Document No. 2005-285368 A). The starter transformer includes a ferrite core, a secondary winding wound around the ferrite core, a sealing portion surrounding the secondary winding, and a primary winding wound around the sealing portion. A socket portion and the sealing portion are formed in a one-piece structure formed by resin molding. The socket portion includes an outer cylindrical portion inside which an outer circumferential surface of a base of the discharge lamp is fitted and an inner cylindrical portion that engage a circular recess at the bottom of the base. An inner electrode is coupled to a high-voltage end of the secondary winding, is exposed at the socket portion, and is surrounded by the outer cylindrical portion of the socket portion. Further, in order to prevent an electric discharge between the inner electrode and electronic parts, such as the capacitors and the spark gap inside the cover, the ferrite core, the secondary winding, and a coupling portion between the secondary winding and the inner electrode is sealed inside the resin molded structure.

However, the resin molding requires special equipment to prevent, for example, blowholes in the resin. Also, the manufacturing process is complicated. Further, in the event that a crack is generated in a rigid portion of the resin due to a temperature variation or aging degradation, an electrical insulation failure may result, making it difficult to maintain stable lighting of the lamp. Furthermore, the resin molded structure increases the weight of the socket itself, which is disadvantageous in that the optical axis of the discharge lamp is likely to deviate from proper alignment due to vibration of the vehicle.

SUMMARY

The present disclosure describes a discharge lamp socket capable of maintaining stable lighting.

According to an aspect of the present invention, a socket for a discharge lamp is provided. The socket includes a housing having a first housing portion and a second housing portion attachable to the first housing portion to cover the first housing portion, a starter circuit having a starter transformer and accommodated inside the housing, a central terminal coupled to the starter transformer and disposed inside the housing such that, when the discharge lamp is attached to the socket, a central electrode of the discharge lamp contacts the central terminal. The first housing portion has a base, and a first wall portion extending from the base in a direction in which the discharge lamp is attached to the socket. The second housing portion has a second wall portion which, when the second housing portion is attached to the first housing portion, overlaps with the first wall portion such that the first and second wall portions surround the central terminal on an inner side of a peripheral edge of the base.

Other aspects and advantages of the invention will be apparent from the following description, the drawings and the claims.

DETAILED DESCRIPTION

Figure 1:
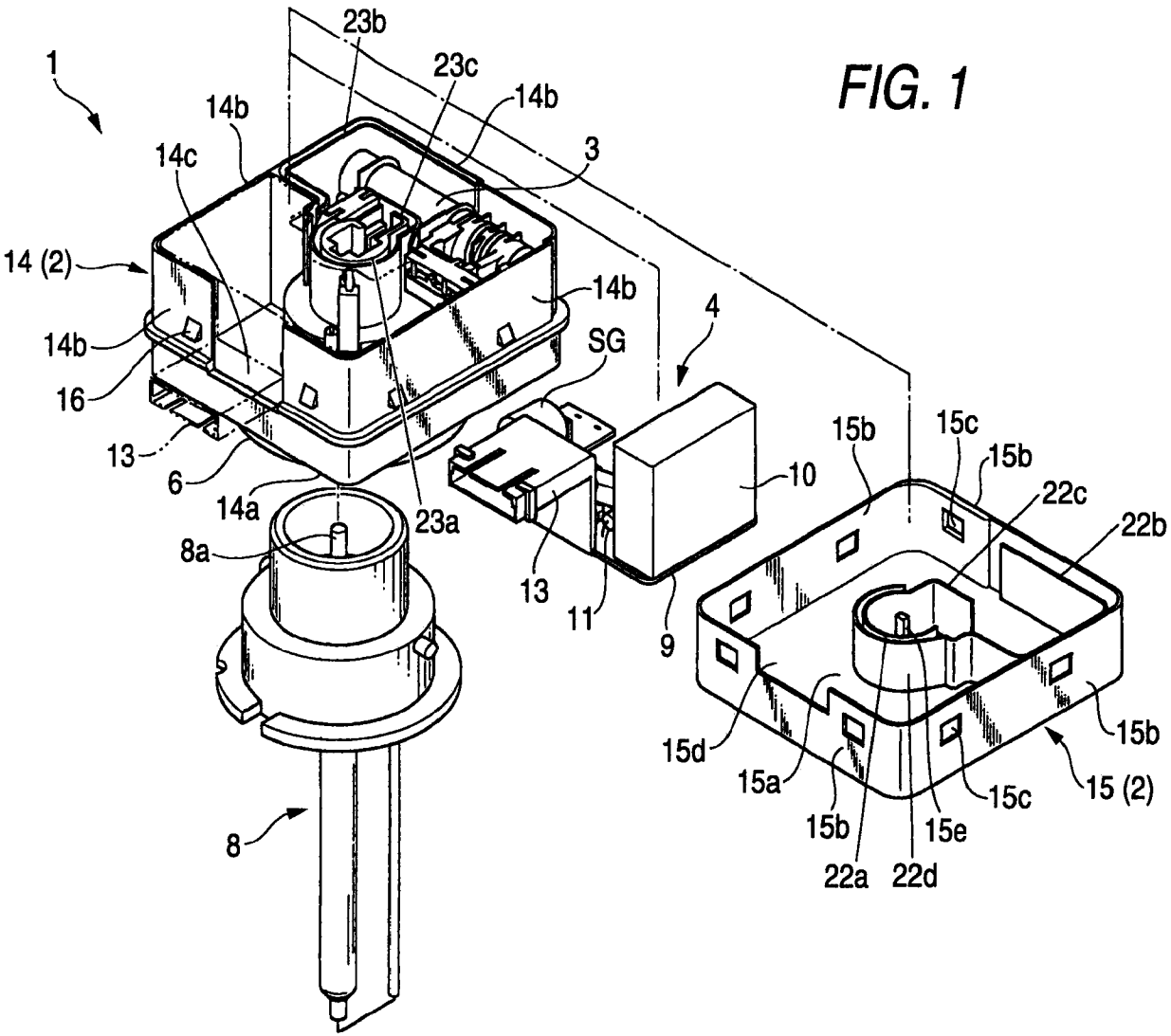
FIG. 1 is an exploded perspective view of a discharge lamp socket according to an exemplary embodiment of the present invention.
Figure 2:
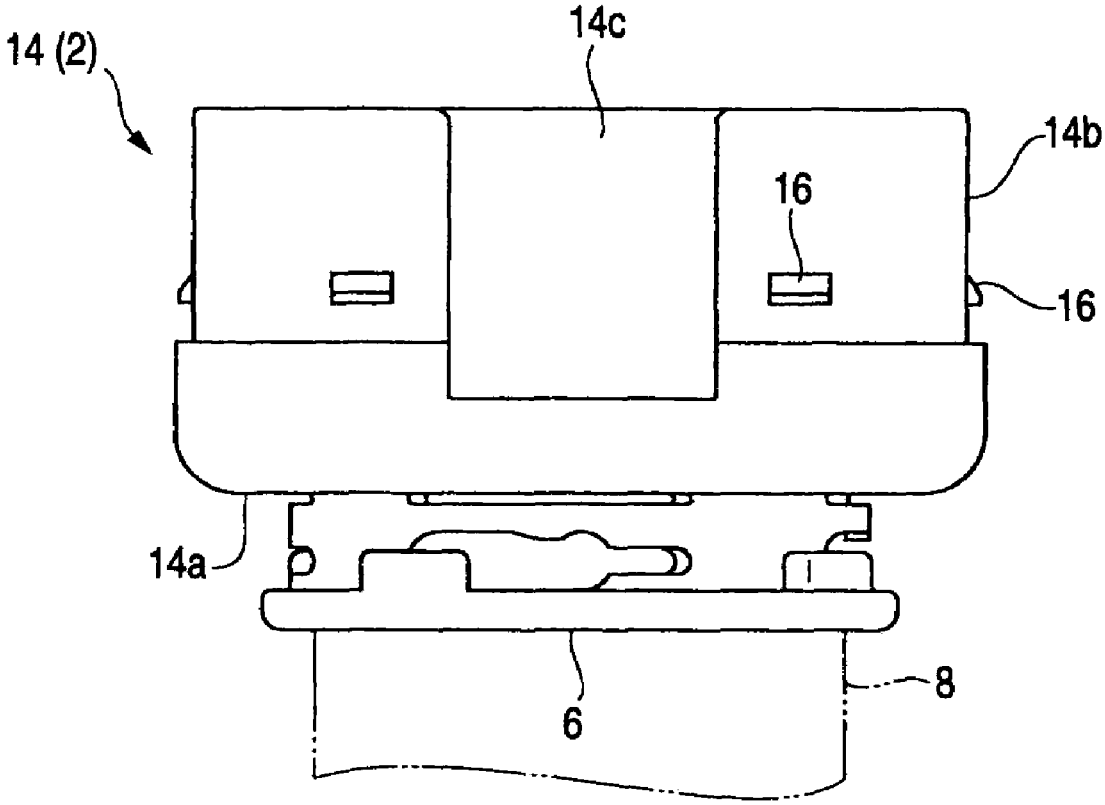
FIG. 2 is a side view of a first housing portion of the socket.
Figure 3:
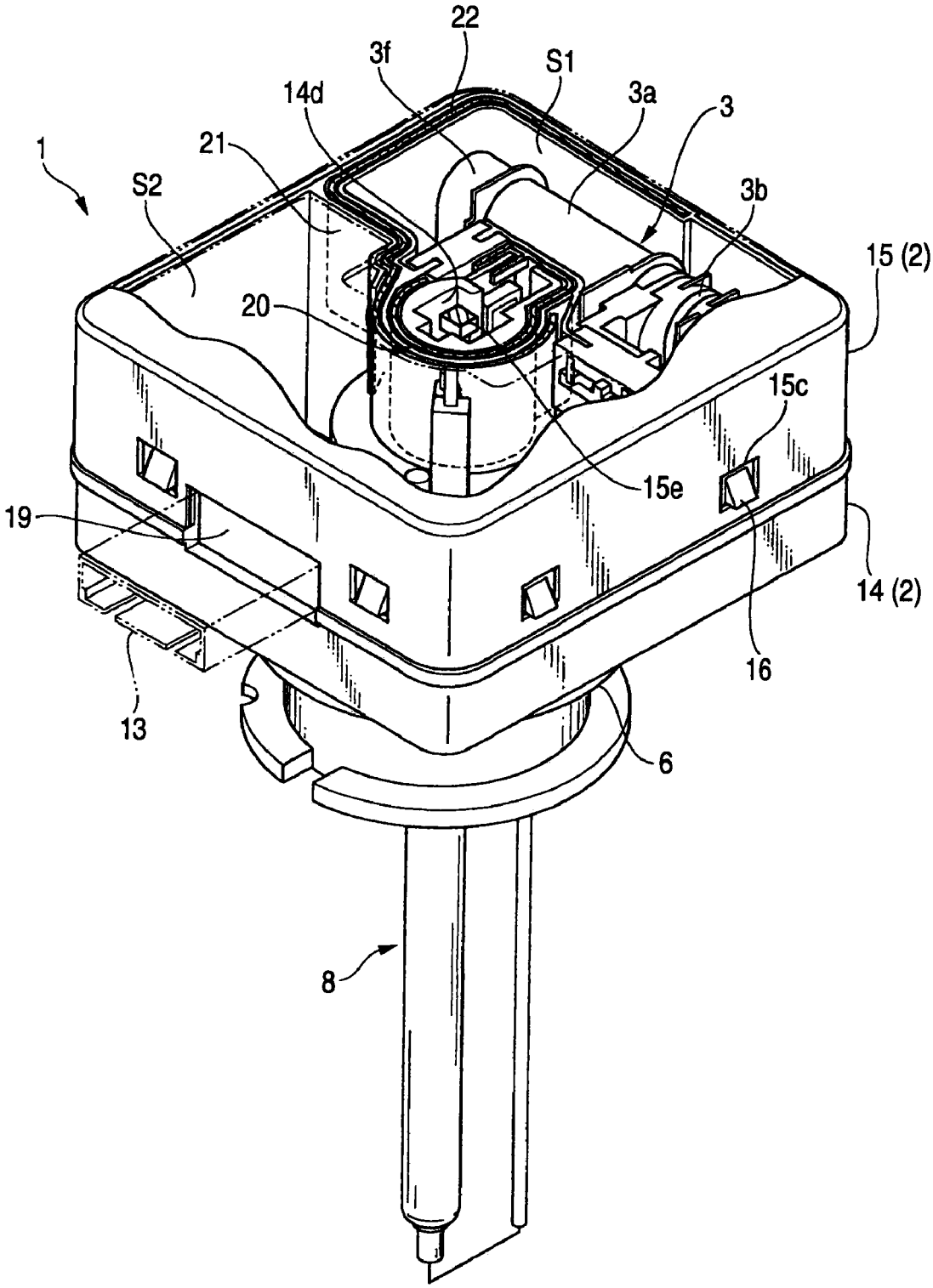
FIG. 3 is a perspective view of the socket which has been assembled.
Figure 4:
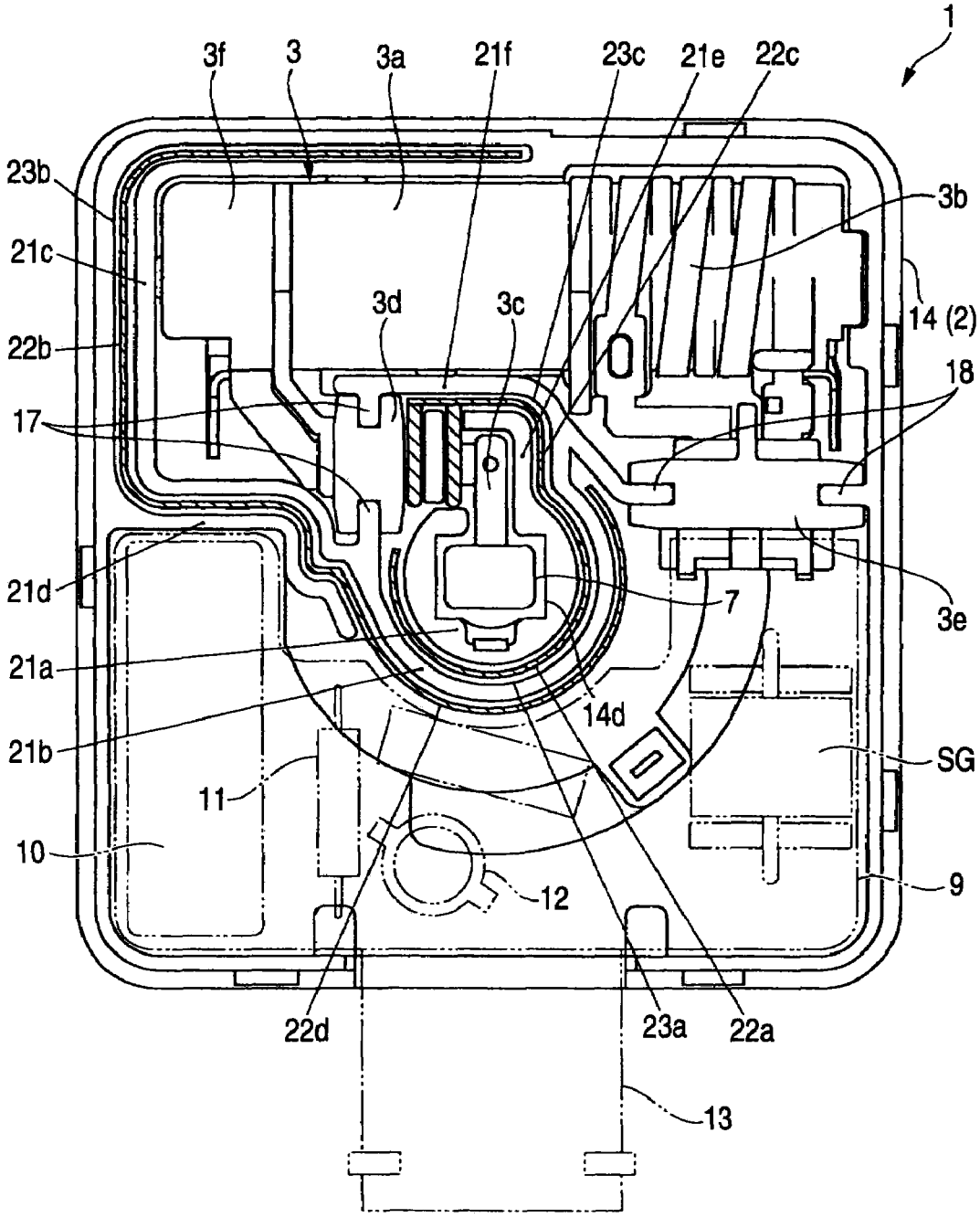
FIG. 4 is a plan view illustrating a state in which a second wall portion is inserted into a groove provided on the first housing portion.

Various examples of embodiments of the invention will be explained below with reference to the drawings. The following exemplary embodiments do not limit the scope of the invention.

A socket 1 is configured to receive a discharge lamp for a headlight of a vehicle. As shown in FIGS. 1 to 4, the socket 1 includes a housing 2, a starter transformer 3 and a charge-discharge circuit portion 4. The housing 2 is a substantially a rectangular parallelepiped, the size of which is, for example, 4 cm (width)×4 cm (length)×2 cm (thickness). The starter transformer 3 and the charge-discharge circuit portion 4 form a starter circuit C1 (see FIG. 6), and are accommodated inside the housing 2. A lighting circuit C2, which will be described later, is not included in the socket 1 so that the size of the socket 1 can be reduced.

The starter transformer 3 includes a rod-shaped magnetic core (not shown), a secondary winding 3*g* wound around the magnetic core, a resin case 3*a* covering an outer circumference of the secondary winding 3*g*, and a primary winding 3*b* wound around an outer circumference of the resin case 3*a*. A high-voltage side terminal 3*c* of the secondary winding 3*g* is coupled to a central terminal 7, which is exposed from a cylindrical lamp attaching portion. The central terminal 7 is fixed to the housing 2 and contacts with the central electrode 8*a* of the discharge lamp 8 to supply a high voltage to the discharge lamp 8.

The charge-discharge circuit portion 4, which is electrically coupled to the starter transformer 3, includes a circuit board 9 formed by insert-molding a metallic plate (not shown) with resin. The metallic plate has an electronic wiring function. The charge-discharge circuit portion 4 further includes a spark gap SG, a capacitor 10, a resistor 11 and a coil 12, which are mounted on the circuit board 9. Terminals of the electronic parts SG, 10, 11, 12 are fixed onto the metallic plate by means of welding. Accordingly, as no solder is used, it is possible to prevent aging degradation of the joint portions regardless of the temperature increase caused by the discharge lamp 8.

Three terminal pins (not shown) connected to the metallic plate are arranged in a connector portion 13. The connector portion 13 and the circuit board 9 are formed in a one-piece structure. An end portion of the connector portion 13 protrudes from the housing 2, and is connected to a plug of a connection cord (not shown) which is connected to the lighting circuit C2. According to such a configuration, a length of the connection cord to be connected to the connector portion 13 can be easily adjusted. Therefore, the socket 1 can be adapted to various types of vehicles.

The housing 2 includes a first housing portion 14 and a second housing portion 15, both of which are made of molded resin such as PBT, PPS or LCP. That is, each of the first and second housing portion 14, 15 is formed in a one-piece structure. The housing 2 is assembled by fitting the second housing portion 15 onto the first housing portion 14. The first housing portion 14 includes a base 14*a*, four side walls 14*b* provided along a peripheral edge of the base 14*a* to form a cup-like shape, and a lamp attaching portion 6 formed integrally with the base 14*a*. The side wall 14*b* extends from the peripheral edge of the base 14*a* in a direction in which the discharge lamp 8 is attached to the socket 1. The lamp attaching portion 6 cylindrically extends in a direction opposite the direction in which the discharge lamp 8 is attached to the socket 1.

The second housing portion 15 includes a base 15*a*, and four side walls 15*b* along a peripheral edge of the base 15*a* to form a cup-like shape. When the housing 2 is assembled, each of the side walls 15*b* overlaps with a corresponding one of the side walls 14*b* of the first housing portion 14 from outer side. The side walls 14*b* of the first housing portion 14 include pawl portions 16 outwardly protruding from respective outer surfaces, and the side walls 15*b* of the second housing portion 15 are formed with rectangular engaging holes 15*c* corresponding to each of the pawl portions 16. Thus, the housing 2 can be assembled with a one-touch operation of engaging the pawl portions 16 with the respective engaging holes 15*c*.

The housing 2 includes a partition wall 20, which, from the perspective of a sectional view taken along a plane substantially perpendicular to the direction in which the discharge bulb 8 is attached to the socket 1, divides a space inside the first housing portion 14 into a first accommodating region S1 in which the starter transformer 3 is disposed and a second accommodating region S2 inside which the charge-discharge circuit portion 4 is disposed. The first housing portion 14 includes a first wall portion 21 which forms part of the partition wall 20 extending between the first accommodating region S1 and the second accommodating region S2. The second housing portion 15 includes a second wall portion 22 which also forms part of the partition wall 20.

The resin case 3*a* of the starter transformer 3 includes a first fitting portion 3*d* formed on one end thereof and a second fitting portion 3*e* formed on the other end thereof. Both the first and second fitting portions 3*d*, 3*e* are H-shaped. The first housing portion 14 includes first engaging protrusions 17 inserted into recess portions of the first fitting portion 3*d* and second engaging protrusions 18 inserted into recess portions of the second fitting portion 3*e*, whereby the starter transformer 3 is fixedly attached to the first housing portion 14. The first and second engaging protrusions 17, 18 are formed integrally with the first housing portion 14. One side wall 14*b* of the first housing portion 14 is formed with a cutout portion 14*c*, and likewise, the corresponding side wall 15*b* of the second housing portion 15 is formed with a cutout portion 15*d*. The cutout portions 14*c*, 15*d* form a rectangular opening 19 through which the connector portion 13 is led out from inside the housing so as to be exposed to the outside.

According to the configuration described above, the socket 1 may consist of four components, namely, the starter transformer 3, the charge-discharge circuit portion 4, the first housing portion 14 and the second housing portion 15. Accordingly, when assembling the socket 1, it is sufficient for only the starter transformer 3 and the charge-discharge circuit portion 4 to be placed in the first and the second accommodating regions S1, S2 respectively. Therefore, the assembly can be improved.

The partition wall 20, which is arranged to surround the central terminal 7, is now described in detail. The partition wall 20 includes the first wall portion 21 extending from the base 14*a* of the first housing portion 14 and the second wall portion 22 extending from the base 15*a* of the second housing portion 15 such that, when the second housing portion 15 is attached to the first housing portion 14, the second wall portion 22 overlaps with the first wall portion 21 in a direction perpendicular to the direction in which the discharge lamp 8 is attached to the socket.

The first wall portion 21 includes a first wall section 21*a* extending in a C-shape so as to surround the central terminal 7, a second wall section 21*b* extending in a larger C-shape so as to surround the first wall section 21*a*, a third wall section 21*c* extending in a U-shape from one end of the second wall section 21*b* toward the side wall 14*b* and along the side wall 14*b* so as to surround a end portion 3*f* of the starter transformer 3 on a high-voltage side; a fourth wall section 21*d* extending in a larger U-shape so as to surround the third wall section 21*c*, a fifth wall section 21*e* extending in an L-shape from an end of the first wall section 21*a* so as to surround a high-voltage side terminal 3*c* of the starter transformer 3, and a sixth wall section 21*f* extending in a larger L-shape from the other end of the second wall section 21*b* so as to surround the fifth wall section 21*e*.

The first wall section 21*a* and the second wall section 21*b* are arranged to extend substantially in parallel one another. The third wall section 21*c* and the fourth wall section 21*d* are arranged to extend substantially in parallel to one another. The fifth wall section 21*e* and the sixth wall section 21*f* are arranged to extend substantially in parallel one another. A first substantially C-shaped groove 23*a* is formed between the first wall and second wall sections 21*a*, 21*b*. A second substantially U-shaped groove 23*b* is formed between the third and fourth wall sections 21*c*, 21*d*. A third substantially L-shaped groove 23*c* is formed between the fifth and sixth wall sections 21*e*, 21*f* The first and third grooves 23*a*, 23*c* can communicate with one another. The second groove 23*b* is opened at one end the fourth wall section 21*d* which is separated from the second wall section 21*b*.

On the other hand, the second wall portion 22 is arranged to correspond to the first wall portion 21. More specifically, the second wall portion 22 includes a first C-shaped section 22*a* to be inserted into the first groove 23*a*, a second U-shaped section 22*b* to be inserted into the second groove 23*b*, and a third L-shaped section 22*c* to be inserted into the third groove 23*c*. The second wall portion 22 further includes a fourth C-shaped section 22*d* extending from an one end of the second section 22*b* adjacently along an outer surface of the second wall section 21*b*. The second wall portion 22 further includes a rod-shaped protruding portion 15*e* extending inside the first section 22*a*. When the second housing portion 15 is attached to the first housing portion 14, this protruding portion 15*e* is inserted into a through-hole portion 14*d* formed on an inner side of the first wall section 21*a*. The central terminal 7 is also inserted into this through-hole portion 14*d* and is fixed by the protruding portion 15*e*.

According to the partition wall 20 described above, a high voltage electric discharge is prevented from being generated between the high-voltage side terminal 3*c* of the secondary wiring of the starter transformer 3 and exposed terminal portions of the spark gap SG, the capacitor 10, the resistor 11 and the coil 12 that are mounted on the circuit board 9. Further, a high voltage electric discharge between the central terminal 7 and the exposed terminal portions of the charge-discharge circuit portion 4 also is prevented by the partition wall 20. According to the exemplary embodiment described above, the partition wall 20 is formed inside the housing 2 only by attaching the second housing portion 15 to the first housing portion 14 such that the first wall portion 21 and the second wall portion 22 overlap one another. Accordingly, a reliable voltage-resistance structure can be created by partition wall 20 without the need for resin molding, i.e. without increasing the weight of the socket. In addition, because the partition wall 20 has a combined structure of overlapping first and second wall portions 21, 22, an even more stable lighting performance can be maintained.

Figure 5:
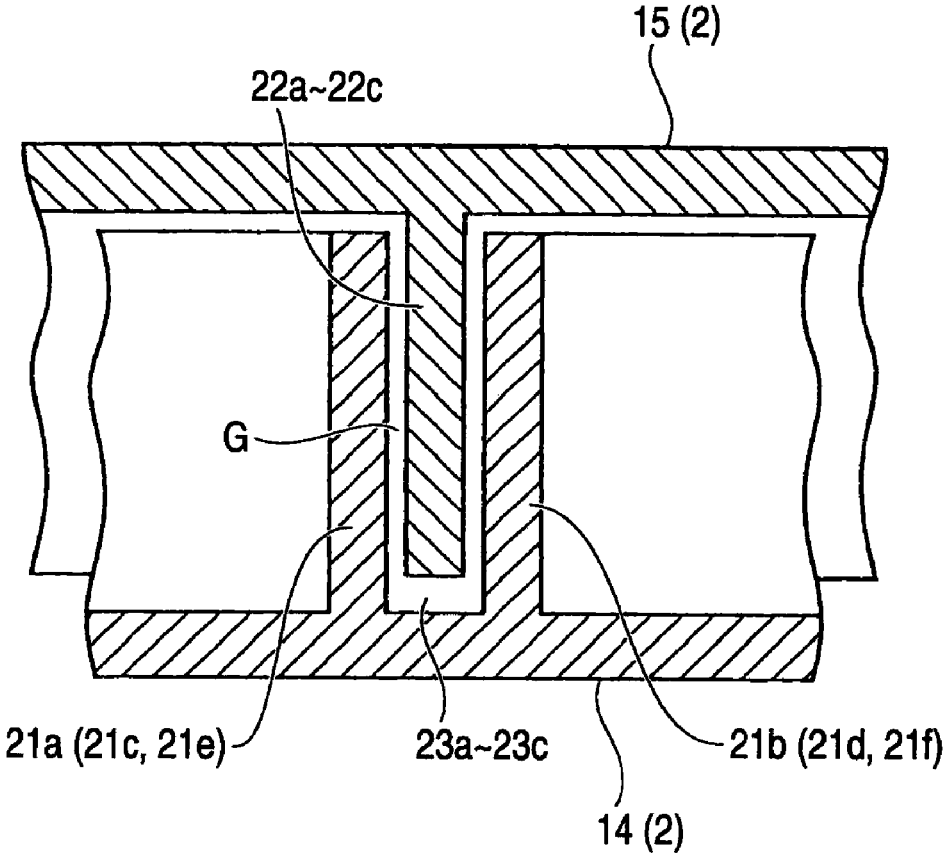
FIG. 5 is a enlarged sectional view illustrating a state in which the second wall portion inserted into the groove formed by first wall portions.

As shown in FIG. 5, when the second wall portion 22 is inserted into the grooves 23*a* to 23*c* formed by the first wall portion 21, the first wall portion 21 and the second wall portion 22 overlap one another with a gap G being formed between the wall portions. This U-shaped gap G increases the length of a creeping passage along the partition wall 20, thereby preventing an electric discharge leakage from the partition wall 20. Thus, it is possible to provide a simple and effective electric insulating wall. For example, where the starter voltage to be generated at the central terminal 7 reaches 22 kV, it is preferable that the length of the gap G be 22 mm or more. However, the first wall portion 21 and the second wall portion 22 may tightly overlap with each other without any gap between.

Although a sufficient electric discharge insulation can be obtained with the partition wall 20 described above, thermosetting resin may be filled in the first accommodating region S1 with the starter transformer 3 being attached to the first accommodating region S1. According to such a configuration, a corona discharge from the starter transformer 3 can be prevented from being generated, and it becomes possible to generate high-voltage pulses more effectively. Moreover, the starter transformer 3 can be prevented from being adversely affected by moisture or humidity entering the socket 1.

Thermosetting resin also may be inserted from a circular resin charging port (not shown), which may be formed on the base 14*a* of the first housing portion 14 to communicate with the second accommodating region S2. According to such a configuration, the charge-discharge circuit portion 4 is prevented from being adversely affected by the moisture or humidity entering the socket 1. An example of the thermosetting resin to be provided in the first and/or second accommodating region S1, S2 to resin-seal the starter transformer 3 and/or the charge-discharge circuit portion 4 is silicon resin, which changes from liquid to gel when it is heated at about 100° C. The thermosetting resin also may be urethane resin or epoxy resin. Thermosetting resin may be such a resin that it is cured after being inserted into the housing 2 with any special treatments.

Next, the starter circuit C1 and the lighting circuit C2, which is a separate component to be connected to the connection cord having the plug to be coupled to the connector portion 13, will be briefly explained below.

Figure 6:
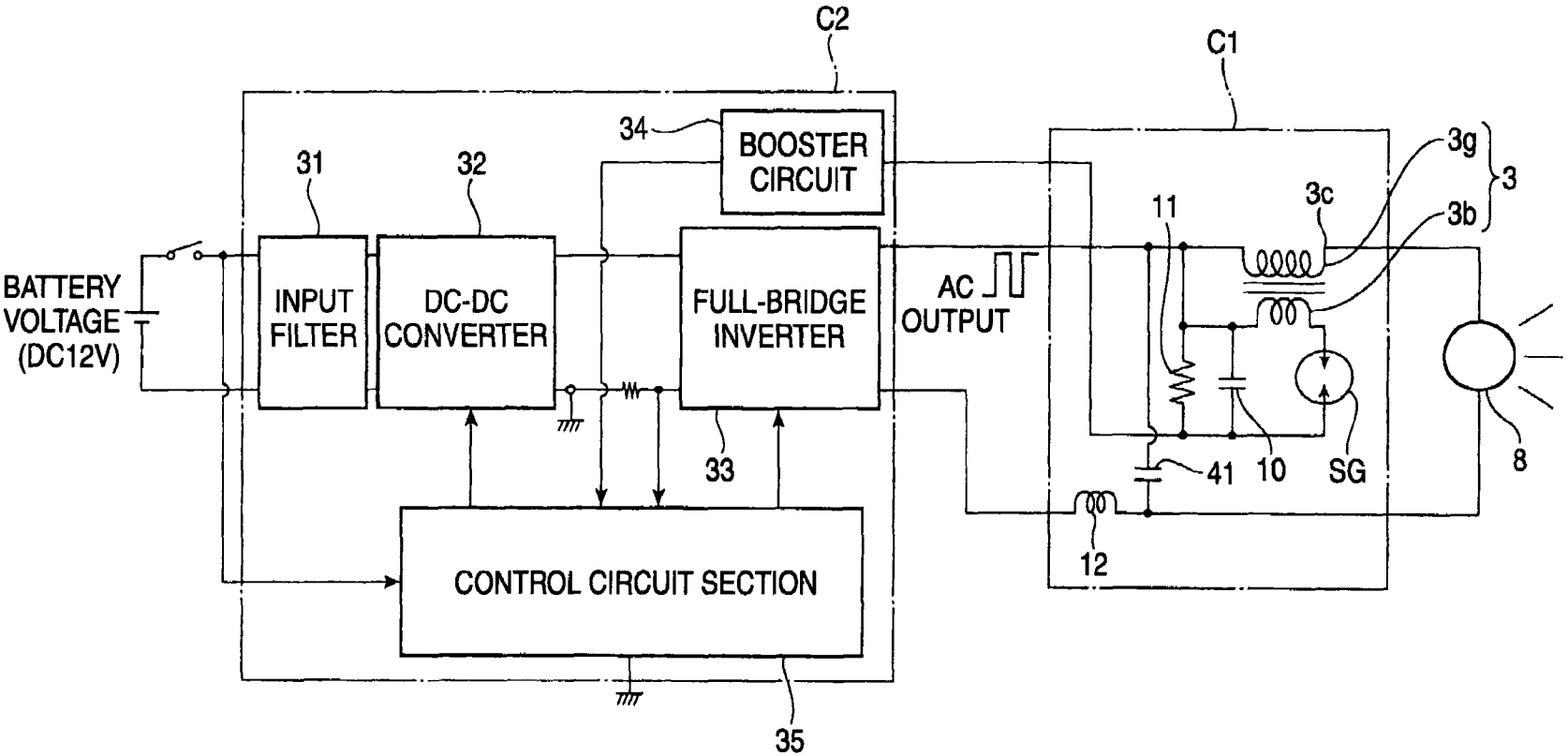
FIG. 6 is a block diagram illustrating a starter circuit and a lighting circuit.

As shown in FIG. 6, in the lighting circuit C2, 12V electricity supplied from a battery mounted on a vehicle is provided to an input filter through which various electric noises are removed, and then, the voltage is boosted up from 12V to a certain voltage (for example, to 45V in a steady state, and to 400V just before lighting) through a DC-DC converter 32. The boosted DC voltage is converted to AC voltage through a full bridge circuit 33 and is supplied to the starter circuit C1. When turning on the discharge lamp 8, a voltage boosted by a booster circuit 34 is supplied to the starter circuit C1. Electric power inside the lighting circuit C2 is controlled by a control circuit portion 35.

In the starter circuit C1, electric charges are stored in the capacitor 10 by the output voltage sent from the booster circuit 34. When the voltage between terminals of the capacitor 10 exceeds a electrical breakdown threshold value of the spark gap SG breaks, the spark gap SG is turned on, and an instantaneous electric current flows in the primary winding 3*b* of the starter transformer 3, whereby a high voltage pulse (the starter voltage 22 kV) is induced between the terminals of the secondary winding 3*g*, that is, at the high-voltage side terminal 3*c* of the secondary winding 3*g*. This high-voltage pulse is superimposed on an output voltage, which is sent from the full bridge circuit 33 through a filter composed of the coil 12 and the capacitor 41, and is supplied to the discharge lamp 8. This high-voltage pulse causes an electrical breakdown in the discharge lamp 8, whereby the discharge lamp 8 starts lighting.

When the discharge lamp 8 starts lighting, impedance is lowered. Thus, the output voltage of DC-DC converter circuit 32 is lowered so that the voltage between the terminals of the capacitor 10 becomes less than the electrical breakdown threshold value of the spark gap SG. Accordingly, a high-voltage pulse is not induced at the high-voltage side terminal 3*c* of the secondary winding 3*g* in the starter transformer 3. In the manner described above, at the time of lighting the discharge lamp 8, the high-voltage pulse is induced at the high-voltage side terminal 3*c* of the secondary winding 3*d* in the starter transformer 3.

The resistor 11 is provided for the purpose of discharging the electric charges stored in the capacitor 10 when a switch connected in series to the battery is turned off.

Although the foregoing description has been made in connection with a particular embodiment of the present invention, those skilled in the art will understand that various changes and modification may be made therein without departing from the present invention.

For example, the housing 2 may be covered by a metallic cap (not shown) such that the resin charging port (not shown) on the base 14*a* of the first housing portion 14 can be closed. Such a metallic cap is effective for reducing a generation of electromagnetic emission noise.

Further, in order to form multiple parallel grooves, the first wall portion may include three or more parallel wall sections and the second wall portion may include two or more parallel wall sections to be inserted into each of the grooves. According to such a configuration, a meandering gap is formed so that the creeping passage along the partition wall can be extended more. Furthermore, the first housing portion 14 may be formed in a one-piece structure. For example, the first wall portion 21 and a bottom wall portion of the first wall portion 21 may be formed as a separate structure from the side walls 14*b*.

Moreover, instead of providing the connector portion 13, one end of a connection cord may be directly coupled to the circuit board 9. In such a case, the connection cord may be led out from the socket 1, and the other end of the connection cord may have a socket to be connected to a connector portion of the lighting circuit C2.

Other implementations are within the scope of the claims.

What is claimed is:

1. A socket for a discharge lamp, the socket comprising:

a housing comprising a first housing portion, and a second housing portion attachable to the first housing portion to cover the first housing portion;

a starter circuit comprising a starter transformer and accommodated inside the housing;

a central terminal coupled to the starter transformer and disposed inside the housing such that, when the discharge lamp is attached to the socket, a central electrode of the discharge lamp contacts the central terminal, wherein the first housing portion comprises a base, and a first wall portion extending from the base in a direction in which the discharge lamp is attached to the socket, and the second housing portion comprises a second wall portion which, when the second housing portion is attached to the first housing portion, overlaps with the first wall portion such that the first and second wall portions surround the central terminal on an inner side of a peripheral edge of the base.

2. The socket according to claim 1, wherein the first housing portion further comprises an engaging portion extending from the first wall portion, and the starter transformer comprises a fitting portion which fits the engaging portion.

3. The socket according to claim 1, wherein at least one of the first and second housing portions is formed in a one-piece structure.

4. The socket according to claim 1, wherein the first wall portion comprises a first wall section and a second wall section extending parallel to one another, and when the second housing portion is attached to the first housing portion, the second wall portion is inserted into a groove between the first and second wall sections.

5. The socket according to claim 4, wherein the second wall portion is inserted into the groove such that a gap is provided between the second wall portion and the first and second wall sections.

6. The socket according to claim 1, wherein the first housing portion further comprises a lamp attaching portion cylindrically extending from the base in an opposite direction from the direction in which the discharge lamp is attached to the socket.

7. The socket according to claim 6, wherein the first housing portion further comprises a side wall extending from the peripheral edge of the base in the direction in which the discharge lamp is attached to the socket.

8. The socket according to claim 1, wherein the starter circuit further comprises a charge-discharge circuit portion comprising a spark gap, a capacitor, and a circuit board on which the spark gap and the capacitor are mounted.

9. The socket according to claim 8, wherein the first wall portion partitions a space inside the housing into a first accommodating region inside which the starter transformer is accommodated and a second accommodating region inside which the charge-discharge circuit portion is accommodated.

10. The socket according to claim 8, further comprising a connector portion protruding out from the housing so as to be coupled to an outside plug, wherein the connector portion and the circuit board are formed in a one-piece structure.

11. The socket according to claim 9, wherein at least a part of the space inside the housing is filled with a thermosetting resin to resin-seal at least one of the starter transformer and the charge-discharge circuit portion.

* * * * *